United States Patent [19]

Swartzbaugh et al.

[11] Patent Number: 4,540,099

[45] Date of Patent: Sep. 10, 1985

[54] TAMPER INDICATING PACKAGE

[75] Inventors: Peter T. Swartzbaugh, Toledo; Edward M. Hehl, Perrysburg, both of Ohio

[73] Assignee: Owens-Illinois, Inc., Toledo, Ohio

[21] Appl. No.: 607,082

[22] Filed: May 4, 1984

[51] Int. Cl.[3] ..... B65D 41/34

[52] U.S. Cl. ..... 215/252; 215/246; 215/273

[58] Field of Search ..... 215/246, 251, 252, 277, 215/273

[56] References Cited

U.S. PATENT DOCUMENTS

| | | | |
|---|---|---|---|
| 811,824 | 2/1906 | Clay | 215/277 |
| 1,923,091 | 8/1933 | Hoffman | 215/251 |
| 2,090,555 | 8/1937 | Sharp | 215/252 |

*Primary Examiner*—Donald F. Norton
*Attorney, Agent, or Firm*—John R. Nelson

[57] ABSTRACT

The tamper indicating package comprising a container having a neck, a closure interengaged with the container, and a tamper indicating device comprising a plurality of radially extending legs adapted to extend radially outwardly and axially about the closure. The legs are joined to one another at their inner ends and an integral annular band joins the other ends of the legs. The band extends beneath the flange of the container when the device is applied over the closure on the container, and the legs are made of a material such that the band will snap and/or shrink radially inwardly after application of the device to a position beneath the flange of the container thereby providing a tamper indicating device.

10 Claims, 6 Drawing Figures

TAMPER INDICATING PACKAGE

This invention relates to tamper indicating packages.

BACKGROUND AND SUMMARY OF THE INVENTION

In the application of closures to containers, it has become known to provide some indication that the closure has been removed in order to indicate to a user that the contents may have been tampered with. In one type of tamper indicating package, a plastic closure is applied to the container and a tamper indicating band is connected by weakened lines to the closure. The band engages a bead on the container such that when the closure is removed, the band is broken from the closure along the weakened line leaving the band on the container.

In one type of closure, the closure is made of plastic and the band is formed after the closure has been molded by a scoring along the periphery of the skirt of the closure. In such a closure, it is necessary to permit the closure to be stored for a long period such as 12 hours before the scoring is applied. This necessitates a delay in the production of the closures between the molding and the scoring operations.

In another type of closure, the band is connected to the skirt of the closure by a plurality of bridges. These bridges are molded in the closure necessitating a more complex mold. In addition the bridges must be such that they will not break upon application but will break upon removal. Accordingly, the prior art structures have disadvantages.

Accordingly, among the objectives of the present invention are to provide a tamper indicating device that can be utilized on conventional existing closures which will function effectively to provide an indication that a closure has been removed or possibly tampered with; which is low in cost and can be readily applied.

In accordance with the invention, the tamper indicating device comprises a plurality of radially extending legs adapted to extend radially outwardly and axially about the closure, said legs being joined to one another at their inner ends, an integral annular band joining the other ends of the legs. The band extends beneath the flange of the container when the device is applied over the closure on the container. The legs are made of a material such that the band can snap and/or shrink radially inwardly after application of the device to a position beneath the flange of the container thereby providing a tamper indicating device.

DESCRIPTION

Figure 3:
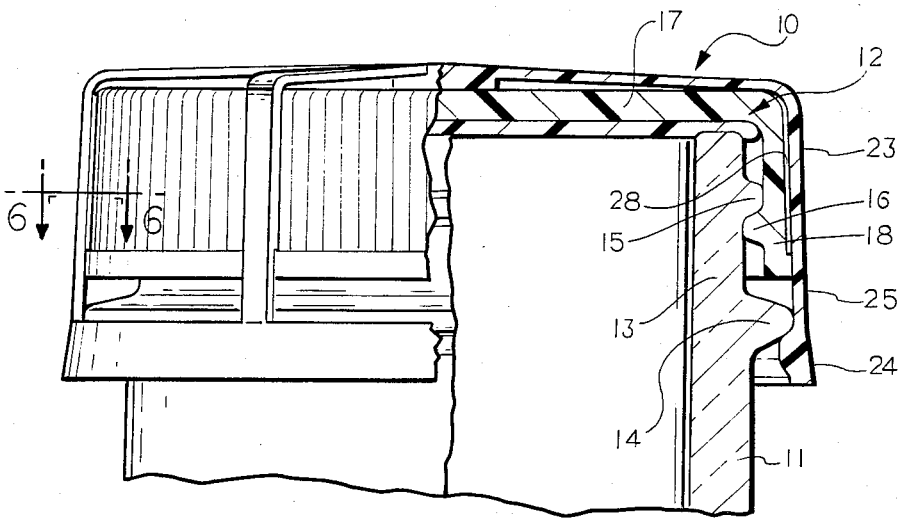
FIG. 3 is a fragmentary part sectional view of a tamper indicating package embodying the invention.

Referring to FIG. 3, the tamper indicating device 10 embodying the invention is intended to be used with conventional glass or plastic containers 11 and closures 12 as for example a container of glass or plastic having a neck 13, a flange 14 on the neck and interengaging means in the form of threads 15 on the neck which engage threads 16 on closure 12. The closure can be made of metal or plastic and includes a base wall 17 and a skirt 18 in which the threads 16 are formed.

Figure 1:
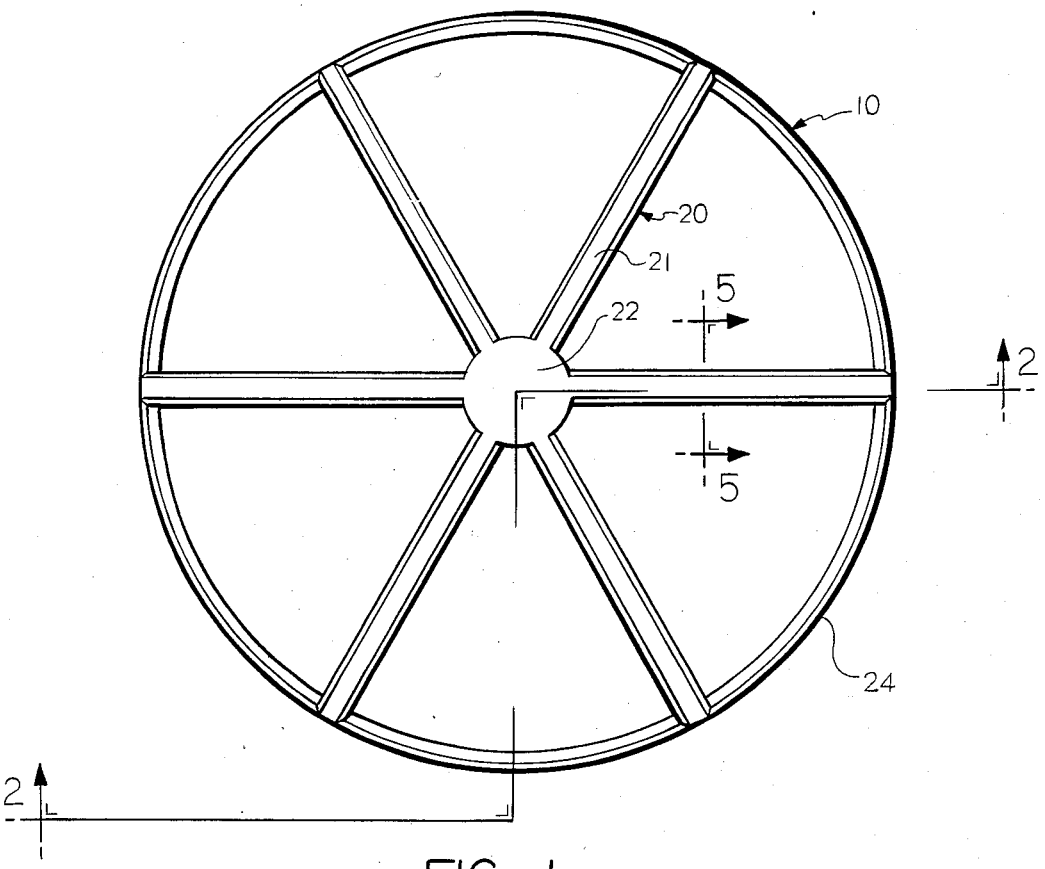
FIG. 1 is a plan view of a tamper indicating band embodying the invention.
Figure 2:
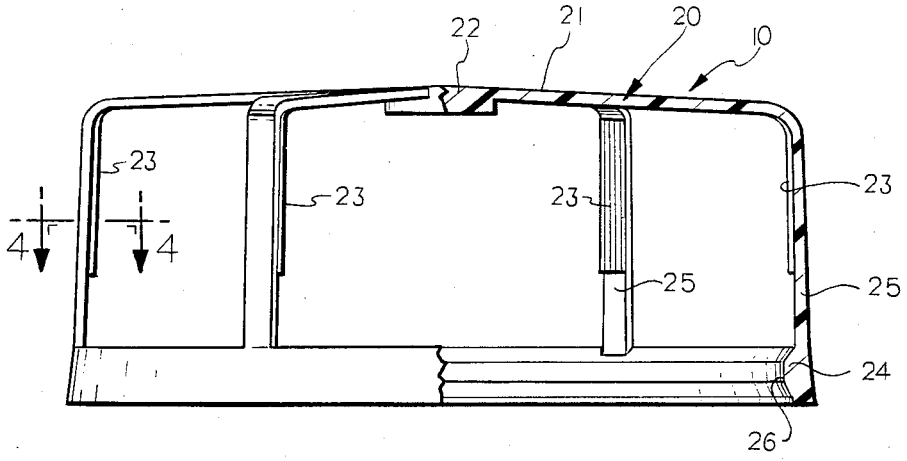
FIG. 2 is a sectional view taken along the line 2—2 in FIG. 1.

Referring to FIGS. 1 and 2, the tamper indicating device 10 embodying the invention comprises a one-piece body having a plurality of legs 20 having portions 21 that are joined at their inner ends the center 22 of the closure 12 and extend radially outwardly and portions 23 that extend axially downwardly about the periphery of the closure 12. The other ends of the portions 22 are joined by a band 24.

Each radial leg portion 21 is preferably trapezoidal in cross section as is each axial leg portion 23. A short portion 25 of each axial portion is of lesser cross sectional area at the juncture with band 24. The band 24 has an integral bead 26 that extends beneath the flange 14 of the container.

When the device is placed on a closure that has been applied to the container, the bead 26 is positioned axially along the container below the flange 14 of the container.

The tamper indicating device 10 is made of a material such that band 24 which will either snap or shrink as, for example, by the application of heat or chemicals so that the band 24 will then move radially inwardly bringing bead 26 beneath the flange 14 to complete the tamper indicating package.

When the tamper indicating band is intended to be held on solely by a snap action, the band is dimensioned such that the internal diameter of the band is less than the outer diameter of the flange 14 such that the bead 25 will be positioned below the flange 14.

When the tamper indicating band is intended to be subjected to heat to position the bead 25 below the flange 14, the internal diameter of the bead may be equal to or slightly less than the diameter of the flange 14 such that the heat will shrink the band 24 bringing the bead below the flange 14.

Satisfactory plastic materials for either a snap fit or a shrink fit comprises polypropylene and high and low density polyethylenes.

When the tamper indicating device 10 is present, it is positive and visual indication that the package has not been tampered with. In order to remove the closure, it is necessary to sever or destroy the tamper indicating device which will readily occur when a force is applied to rotate the closure and remove it. This will cause breakage of the thinner portions 25 of the band.

Figure 4:
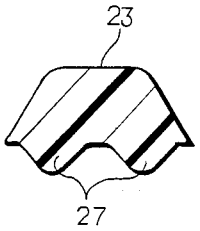
FIG. 4 is a sectional view taken along the line 4—4 in FIG. 2.
Figure 5:
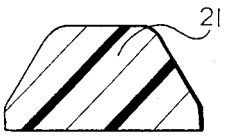
FIG. 5 is a sectional view taken along the line 5—5 in FIG. 1.
Figure 6:
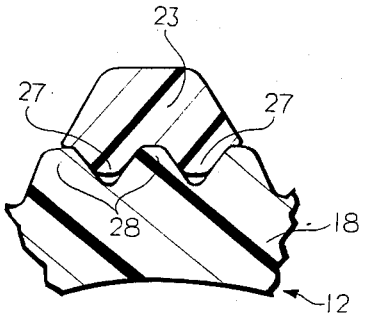
FIG. 6 is a sectional view taken along the line 6—6 in FIG. 3.

The axial portions 23 preferably are formed with axial ribs 27 (FIG. 4) which interengage the axial ribs 28 on the closure (FIG. 6) to prevent relative rotation between the tamper indicating device and the closure.

We claim:

1. A tamper indicating device for a tamper indicating package comprising a container having a neck and a flange on the neck, a closure having a base and a skirt, interengaging means between the closure and the container operable to hold the closure on the container, said tamper indicating device comprising a plurality of radially extending circumferentially spaced legs having inner ends and outer ends and having portions adapted to extend radially outwardly and axially about the closure, said legs being joined to one another at their inner ends, an integral annular band joining the outer ends of the legs, said band adapted to extend beneath the flange of the container when the device is applied over the closure on the container, said legs being of a material such that the band will move radially inwardly after application of the device to a position beneath the flange of the container thereby providing a tamper indicating device.

2. The tamper indicating package set forth in claim 1 wherein said skirt of said closure and said band of said tamper indicating device includes interengaging means inhibiting rotation of the closure except by severing of the device.

3. The tamper indicating package comprising a container having a neck, a closure having a base and a skirt, interengaging means between the closure and the container operable to hold the closure on the container, and a tamper indicating device comprising a plurality of radially extending circumferentially spaced legs having inner ends and the outer ends and having portions adapted to extend radially outwardly and axially about the closure, said legs being joined to one another at their inner ends, an integral annular band joining the other ends of the legs, said band being beneath the flange of the container when the device is applied over the closure on the container, said legs being of a material such that the band will move radially inwardly after application of the device to a position beneath the flange of the container thereby providing a tamper indicating device.

4. The tamper indicating package set forth in claim 3 wherein said skirt of said closure and said band of said tamper indicating device includes interengaging means inhibiting rotation of the closure except by severing of the device.

5. A tamper indicating device for a tamper indicating package comprising a container having a neck and a flange on the neck, a closure having a base and a skirt, interengaging means between the closure and the container operable to hold the closure on the container, said tamper indicating device comprising a plurality of radially extending circumferentially spaced legs having inner ends and outer ends and having portions adapted to extend radially outwardly and axially about the closure, said legs being joined to one another at their inner ends, an integral annular band joining the outer ends of the legs, said band adapted to extend beneath the flange of the container when the device is applied over the closure on the container, said legs being of a material such that the band will move radially inwardly after application of the device to a position beneath the flange of the container thereby providing a tamper indicating device skirt of said closure and said band of said tamper indicating device includes interengaging means inhibiting rotation of the closure except by severing of the device, wherein said interengaging means comprise axial ribs on the axially extending portions of said legs adapted to engage axial ribs on said skirt of said closure.

6. The tamper indicating device set forth in claim 5 wherein the band is dimensioned so that the internal diameter of the band is less than the outer diameter of the flange of the container such that the band will snap over the flange.

7. The tamper indicating device set forth in claim 5 wherein the device is made of a material that will shrink when subjected to heat such that the band of the device will shrink below the flange.

8. The tamper indicating package comprising a container having a neck, a closure having a base and a skirt, interengaging means between the closure and the container operable to hold the closure on the container, and a tamper indicating device comprising a plurality of radially extending circumferentially spaced legs having inner ends and outer ends and having portions adapted to extend radially outwardly and axially about the closure, said legs being joined to one another at their inner ends, an integral annular band joining the other ends of the legs, said band being beneath the flange of the container when the device is applied over the closure on the container, said legs being of a material such that the band will move radially inwardly after application of the device to a position beneath the flange of the container thereby providing a tamper indicating device, said skirt of said closure and said band of said tamper indicating device includes interengaging means inhibiting rotation of the closure except by severing of the device, said interengaging means comprises axial ribs on the axially extending portions of said legs and axial ribs on said skirt of said closure interengaging said ribs on said legs.

9. The tamper indicating package set forth in claim 8 wherein the band is dimensioned so that the internal diameter of the band is less than the outer diameter of the flange of the container such that the band will snap over the flange.

10. The tamper indicating package set forth in claim 8 wherein the device is made of a material that will shrink when subjected to heat such that the band device will shrink below the flange.

* * * * *